US007318521B2

(12) United States Patent
Lau

(10) Patent No.: US 7,318,521 B2
(45) Date of Patent: Jan. 15, 2008

(54) POUCH WITH INTEGRATED STAND

(75) Inventor: Wee Min Alfred Lau, Singapore (SG)

(73) Assignee: Creative Technology Ltd, Singapore (SG)

( * ) Notice: Subject to any disclaimer, the term of this patent is extended or adjusted under 35 U.S.C. 154(b) by 413 days.

(21) Appl. No.: 10/946,725

(22) Filed: Sep. 21, 2004

(65) Prior Publication Data

US 2006/0060476 A1 Mar. 23, 2006

(51) Int. Cl.
*B65D 85/00* (2006.01)

(52) U.S. Cl. ..... 206/45.24; 206/320

(58) Field of Classification Search ..... 206/45.2, 206/45.23, 45.24, 305, 320, 764, 765
See application file for complete search history.

(56) References Cited

U.S. PATENT DOCUMENTS 4,259,568 A * 3/1981 Dynesen ..... 235/1 D
4,424,899 A * 1/1984 Rosenberg ..... 206/305
4,703,160 A * 10/1987 Narishima et al. ..... 235/1 D
5,435,437 A * 7/1995 Sasaki ..... 206/45.23
5,996,778 A * 12/1999 Shih ..... 206/45.2
6,450,328 B1 * 9/2002 Machacek et al. ..... 206/63.5
6,925,739 B1 * 8/2005 Cole et al. ..... 40/120
7,134,548 B2 * 11/2006 Meehan et al. ..... 206/315.1

* cited by examiner

*Primary Examiner*—David T. Fidei
(74) *Attorney, Agent, or Firm*—Russell N. Swerdon

(57) ABSTRACT

A pouch with an integrated stand for releasably holding therein an electronic device. The pouch comprises a body having a longitudinally extending upper strap and a longitudinally extending lower strap. There is a side at each end of the pouch extending between the upper strap and the lower strap; and a rear wall extending between the sides. A cover is hingedly connected to the rear wall and is moveable between a first position closing the pouch, and a plurality of open positions. The plurality of open position comprise a first open position wherein the cover supports the body in the first orientation, and a second open position wherein the body in a second orientation. The sides may be of reduced depth compared to sides of the electronic device to create an opening through which access may be had to controls of the electronic device on the sides of the electronic device when the cover is in the first position.

23 Claims, 4 Drawing Sheets

POUCH WITH INTEGRATED STAND

FIELD OF THE INVENTION

This invention relates to pouch with an integrated stand and refers particularly, though not exclusively, to such a pouch for use with an electronic device.

BACKGROUND OF THE INVENTION

Electronic devices such as, for example, media players are often used with a pouch to protect the device, and assist in carrying the device. When the device is to be used it is normally placed on a separate stand, rested against a book or the like, quite often causing user dissatisfaction.

SUMMARY OF THE INVENTION

In accordance with the first aspect there is provides a pouch with an integrated stand for releasably holding therein an electronic device. The pouch comprises a body having a longitudinally extending upper strap and a longitudinally extending lower strap. There is a side at each end of the pouch extending between the upper strap and the lower strap; and a rear wall extending between the sides. A cover is hingedly connected to the rear wall and is moveable between a first position closing the pouch, and a plurality of open positions. The plurality of open positions may comprise a first open position wherein the cover supports the body in a first orientation, and a second open position wherein the cover supports the body in a second orientation. The sides may be of reduced depth compared to sides of the electronic device to create an opening through which access may be had to controls of the electronic device on the sides of the electronic device when the cover is in the first position.

The cover may comprise a minor portion hingedly connected to the rear wall, and a major portion in a fixed relationship relative to the minor position. The fixed relationship may be perpendicular.

The rear wall may be of a height greater than a height of the electronic device.

The pouch may further comprise a latch, the comprising a first part on the minor portion and a second part on the rear wall for releasably retaining the cover in the first orientation.

The pouch may further comprise a catch, the catch comprising a first part on the major portion and a second part on the lower straps for releasably retaining the cover in the first position.

The pouch may further comprise a base with an opening at each end of the base. The base, the lower strap and the rear wall may comprise a receptacle into which the electronic device is releasably receivable.

DETAILED DESCRIPTION OF THE DRAWINGS

In order that the invent may be fully understood and readily put into practical effect, there shall now be described by way of non-limitative example only preferred embodiments of the present invention, the description being with the reference to the accompanying illustrative drawings in which.

DETAILED DESCRIPTION OF THE PREFERRED EMBODIMENTS

Figure 1:
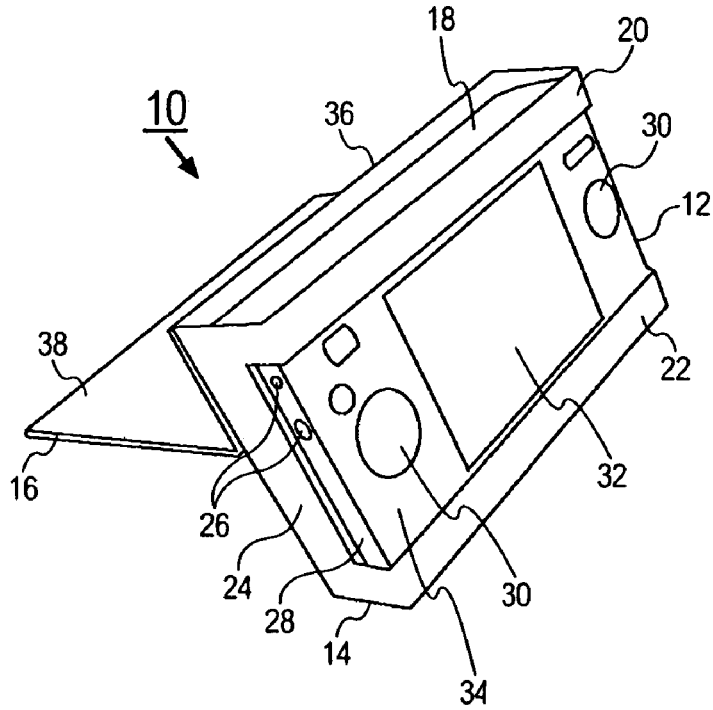
FIG. 1 is a front perspective view of the first embodiment in a first orientation.

To refer to the drawings, there is shown a pouch 10 for releasably holding therein an electronic device 12 such as, for example, a media player.

The pouch 10 has a body 14 and a cover 16 hingedly attached to or integral with body 14. The body 14 has a open top 18 through which electronic device 12 can be placed in pouch 10. Upper 20 and lower 22 longitudinally extending straps are used to releasably hold device 12 in pouch 10. Straps 20, 22 are spaced apart, generally parallel and substantially co-planar. Extending between upper strap 20 and lower strap 22 are sides 24 at each end of pouch 10. Sides 24 are of reduced depth to form a gap 56 between straps 20, 22. Straps 20, 22 and sides 24 are such that all necessary controls 26 or sides 28 device 12 are accessible through gaps 56 even when cover 16 is closed; and controls 30 and screen/display 32 of device 12 on front 34 of device 12 are accessible when cover 16 is open. As such sides 24 are of less depth that sides 28 of device 12.

The cover 16 has a main portion 38 and a minor portion 40, and can move relative to body 14 about the hinge line 36. The cover 16 can be placed in a first open position as shown in FIG. 1 with minor portion 40 against rear wall 42 of the body 14, or in a second open position with major portion 38 lying flat on a surface (not shown) and with portion 40 angled relative to rear wall 42. The major portion 38 is perpendicular to minor portion 40, and minor portion is hingedly connected to rear wall 42 at the upper edge of rear wall 42 along hinge line 36. In the first open position the body 14 is at an angle to the surface of about 60°, and in the second open position the body is at an angle to the surface of about 25°. In the second open position, the angle between minor portion 40 and rear wall 42 will be about 65°.

Figure 5:
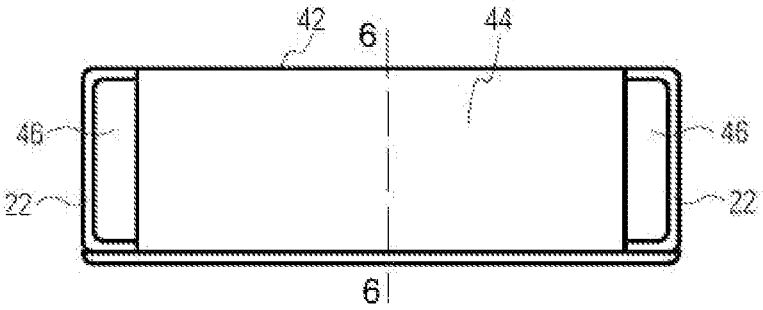
FIG. 5 is an end underneath view of the pouch of FIG. 4.

The body 14 has a base 44 (FIG. 5) with openings 46 at each end thereof to enable a digit (finger or thumb) of a user to pass therethrough to provide the initial phase of removing device 12 from pouch 10. The straps 20, 22 and sides 24 have a relatively tight, but releasable, hold on device 12 so the openings 46 are of assistance in the removal.

The rear wall 42, and/or straps 20, 22, may extend above and beyond device 12 to provide some protection for device 12 if pouch 10 dropped when device 12 is in the pouch 10.

Rear wall 42 preferably has an insert plate 48 extending for the majority of the height of rear wall 42, and the majority of the width of rear wall 42. Plate 48 is made of, or contains, a magnetic metal to act as a shield for any magnetically sensitive mechanism in device 12 such as, for example, a disk drive.

The cover 16 preferably has an inset of a stiffening material 50 such as for example, cardboard, plastics or the like. Alternatively, cover 16 may be made of a relatively stiff material.

Rear wall 42 and minor portion 40 each have part of a releasably securable latch 48, 50 respectively. These may be "Velcro", press-stud, magnets, magnets and a steel plate, and so forth. When latch components 48, 50 are engaged, the cover 16 is in the position of FIGS. 2 and 3. The latch may comprise a magnet 48 in minor portion 40 and the second part 50 may be plate 48 if plate 48 is of, or contains, a magnetic material. If either or both of the latch positions 48, 50 are magnetic, plate 48 is or contains a magnetic material such as, for example, steel. For example, plate 48 may be a steel pate, or an epoxy or plastics material encasing a fine steel mesh, or may be a fine but relatively stiff steel mesh.

Similarly, lower strap 22 and major portion 38 have corresponding catch components 52, 54 that may be "Velcro", press stud, magnets, magnet and steel plate, or the like. This serves to keep cover closed when in the position shown in FIGS. 4 and 6.

Figure 7:
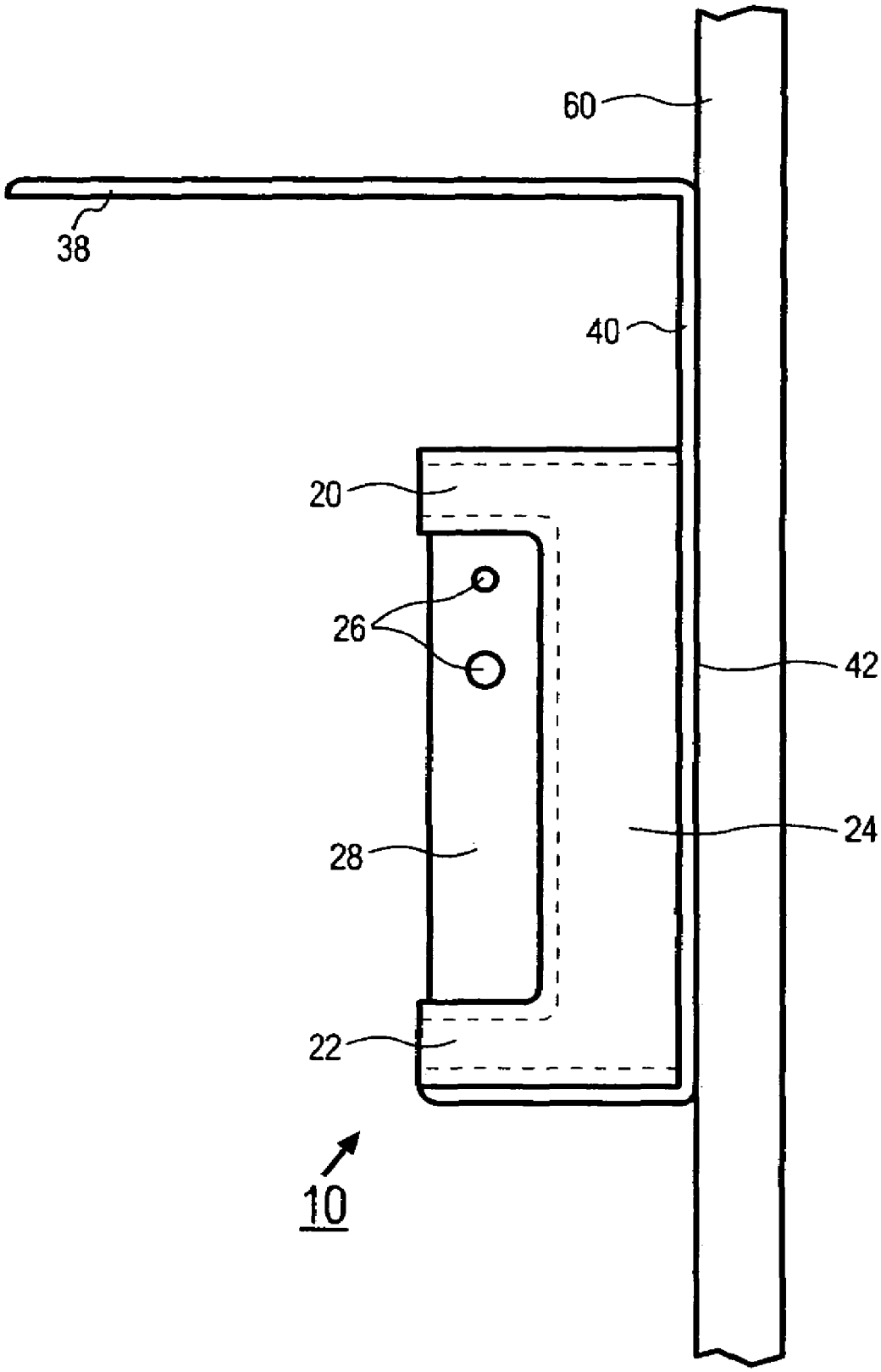
FIG. 7 is a side view of the pouch of FIGS. 1 to 3 in a fourth orientation.

If the latch component 50 is a magnet, it may also be used in a third open position to releasably attach the pouch 10 to a magnetic material such as, for example, a magnetic white board 60 (FIG. 7). Due to the relatively rigid nature of major portion 38 and minor portion 40, the minor portion 40 is relatively co-planar with rear wall 42. Major portion 38 extends outwardly and generally perpendicular to board 60. It therefore acts as a shield or cover for display 32 to reduce unwanted reflection. Major portion 38 may also act as a shelf on which may be placed such things as marker pens, and the like.

Figure 2:
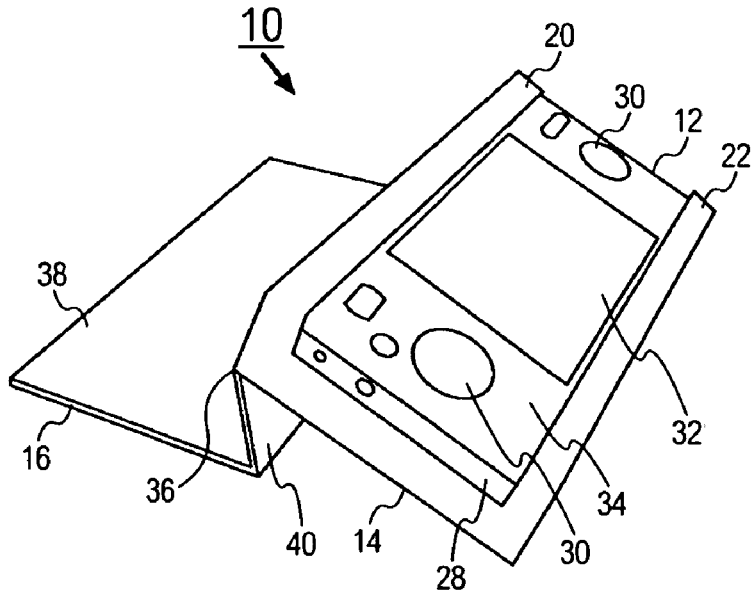
FIG. 2 is a view corresponding to FIG. 1 in a second orientation.
Figure 3:
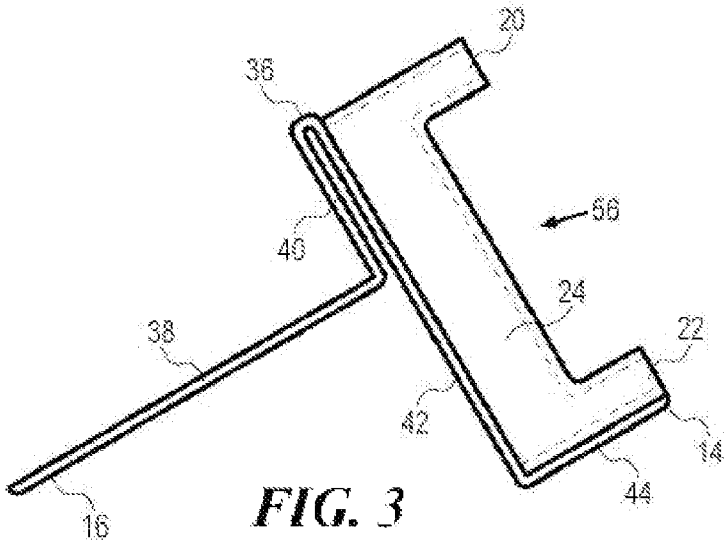
FIG. 3 is an end view of the pouch of FIGS. 1 and 2 is the first orientation.
Figure 4:
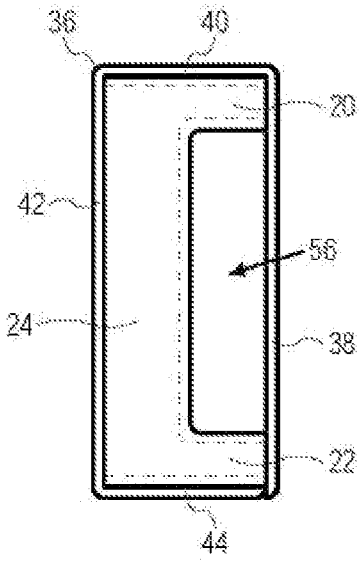
FIG. 4 is an end view of the pouch of FIGS. 1 to 3 in a third orientation.
Figure 6:
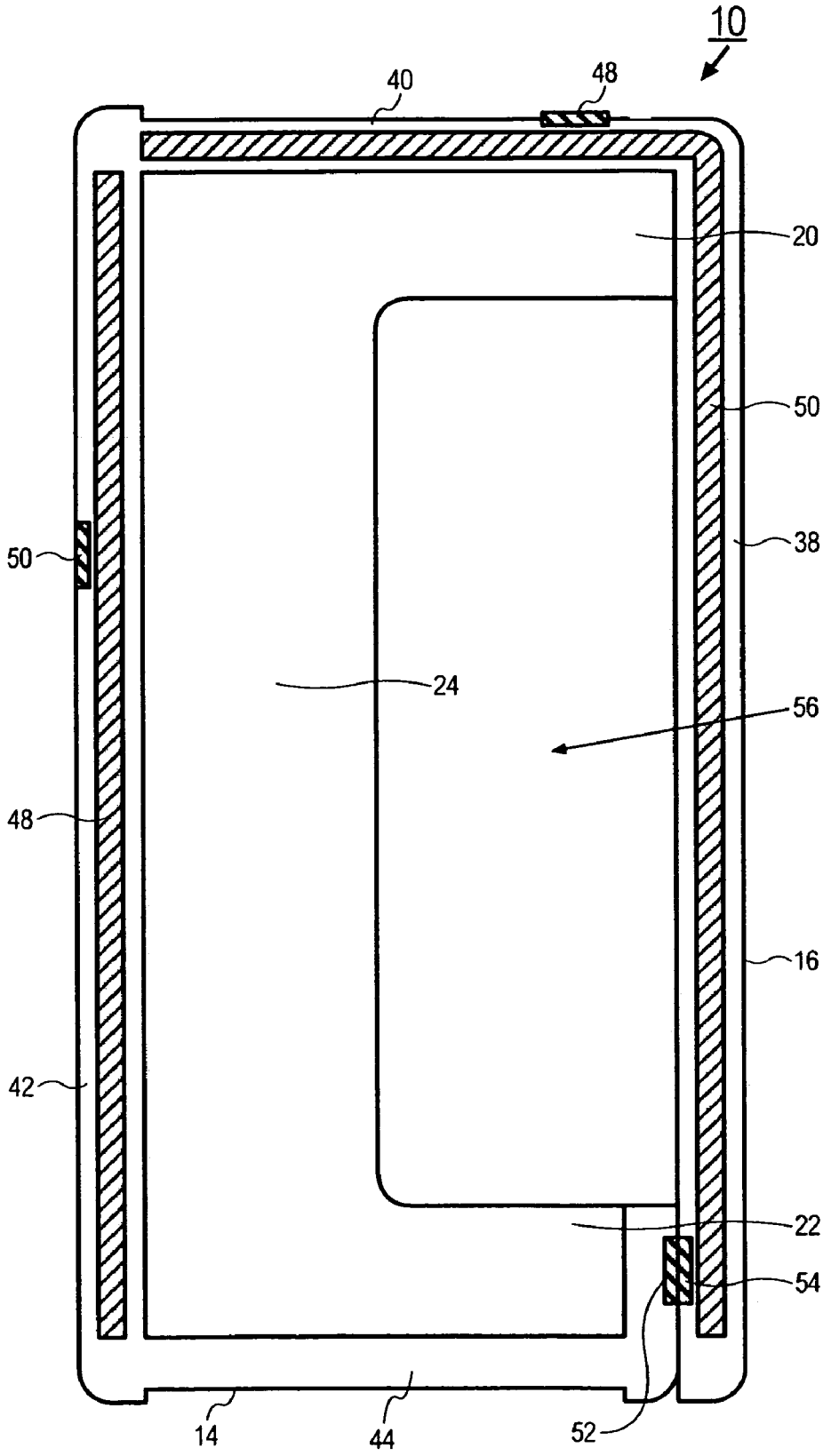
FIG. 6 is a vertical cross-sectional view along the lines and in the directions of arrows 6-6 on FIG. 5.

Therefore, the cover 16 has a number of preset positions relative to body 14:

(1) closed, as shown in FIGS. 4 and 6;

(2) open in the first open position and being used as a support for body 14 in a first orientation as shown in FIGS. 1 and 3, with minor portion 40 against rear wall 42;

(3) open in the second open position and being used as a support for body 14 in a second orientation as shown in FIGS. 2 and 4, with major portion 38 on a surface (not shown) and minor portion 40 angled away rear wall 42; and being perpendicularly to the surface;

(4) open in the third open position and being releasbly attached to a magnetic surface as shown in FIG. 7, minor portion 40 and rear wall 12 being co-planar; and (5) fully open in a fourth open position and not being used as support body 14 as body 14 rests on rear wall 42 or base 44.

The pouch 10 is preferably made of materials such as leather, vinyl, and the like.

Preferably, the distance between straps 20, 22 is the same as or slightly greater than the height of display/screen 32. By not having vertical straps, controls 30 on front 34 are accessible wherever cover 16 is open. By sides 24 being a reduced depth compared to sides 28 of device 12, there is a gap 56 between sides 24 and cover 16 when cover 16 is closed. This enables access to controls 26 (including earphone/headphone ports) so device 12 can be used as, for example, an audio player (e.g. MP3 or MP4 player) when cover 16 is closed.

The combination of rear wall 42, lower strap 22, and base 44 forms a receptacle in which device 12 sits whenever in the pouch 10.

Whilst there has been described in the foregoing description preferred embodiments of the present invention, it will be understood by those skilled in the technology that many variations or modifications in details of design or construction may be made without departing from the present invention.

What is claimed is:

1. A pouch with an integrated stand for releasably holding therein an electronic device, the pouch comprising:

(a) a body having a longitudinally extending upper strap and a longitudinally extending lower strap; side panels, each side panel positioned at each end of the pouch and extending between the upper strap and the lower strap; and a rear wall extending between the side panels; and (b) a cover comprising a minor portion hingedly connected to the rear wall, a major portion at a fixed relationship relative to the minor portion, said cover moveable between a first position closing the pouch, and a plurality of open positions; the plurality of open positions comprising a first position wherein the cover supports the body in a first orientation, and a second position wherein the cover supports the body in a second orientation.

2. A pouch with an integrated stand for releasably holding therein an electronic device, the pouch comprising:

(a) a body having a longitudinally extending upper strap and a longitudinally extending lower strap; side panels, each side panel positioned at each end of the pouch and extending between the upper strap and the lower strap; and a rear wall extending between the side panels; and (b) a cover comprising a minor portion hingedly connected to the rear wall, a major portion at a fixed relationship relative to the minor portion, said cover moveable between a first position closing the pouch, and a plurality of open positions; wherein the side panels are of reduced depth compared to sides of the electronic device to create an opening through which access may be had to controls of the electronic device on the sides of the electronic device when the cover is in the first position.

3. A pouch as claimed in claim 1, wherein the fixed relationship comprises perpendicularity between the major portion and the minor portion.

4. A pouch as claimed in claim 1, wherein the side panels are of reduced depth compared to sides of the electronic device to create an opening through which access may be had to controls of the electronic device on the sides of the electronic device when the cover is in the first position.

5. A pouch as claimed in claim 2, wherein the fixed relationship comprises perpendicularity between the major portion and the minor portion.

6. A pouch as claimed in claim 2, wherein the plurality of open positions comprises at least one selected from the group consisting of: a first open position wherein the cover supports the body in a first orientation, a second open position wherein the cover supports the body in a second orientation, and a third open position wherein the cover holds the body in a third orientation on a planar, magnetic body.

7. A pouch as claimed in claim 1, wherein the rear wall is of a height greater than a height of the electronic device.

8. A pouch as claimed in claim 2, wherein the rear wall is of a height greater than a height of the electronic device.

9. A pouch as claimed in claim 1, further comprising a latch, the latch comprising a first part on the minor portion and a second part on the rear wall for releasably retaining the cover in the first orientation.

10. A pouch as claimed in claim 1, further comprising a catch, the catch comprising a first part on the major portion and a second part on the lower strap for releasably retaining the cover closed in the first position.

11. A pouch as claimed in claim 2, further comprising a latch, the latch comprising a first part on the minor portion and a second part on the rear wall for releasably retaining the cover in the first orientation.

12. A pouch as claimed in claim 2, further comprising a catch, the catch comprising a first part on the major portion and a second part on the lower strap for releasably retaining the cover in the first position.

13. A pouch as claimed in claim 1, wherein the body further comprises a base with an opening at each end of the base.

14. A pouch as claimed in claim 2, wherein the body further comprises a base with an opening at each end of the base.

15. A pouch as claimed in claim 13, wherein the base, the lower strap and the rear wall comprise a receptacle into which the electronic device is releasably receivable.

16. A pouch as claimed in claim 14, wherein the base, the lower strap and the rear wall comprise a receptacle into which the electronic device is releasably receivable.

17. A pouch as claimed in claim 13, the plurality of open positions further comprising a third open position wherein the body stands on the base, the cover not supporting the body.

18. A pouch as claimed in claim 6, wherein the body further comprises a base with an opening at each end of the base, the plurality of open positions further comprising a fourth open position wherein the body stands on the base, the cover not supporting the body.

19. A pouch as claimed in claim 6, wherein in the first open position, the minor portion of the cover is against the rear wall; in the second open position the minor portion is at an angle relative to the rear wall; and in the third open position the minor portion is co-planar with the rear wall.

20. A pouch as claimed in claim 19, wherein the angle is 65°.

21. A pouch as claimed in claim 6, wherein the body is at an angle to a surface on which the body rests such that when the body is in the first open position the angle is 60°, and when the body is in the second position the angle is 25°.

22. A pouch with an integrated stand for releasably holding therein an electronic device, the pouch comprising:

(a) a body having a front panel with an opening adapted for provided visibility to a display screen of the electronic device contained within the pouch; a rear wall substantially parallel to the front panel, and at least one side panel joining the front panel and the rear wall; wherein the front panel comprises at least one longitudinally extending strap bounding the opening and (b) a cover comprising a minor portion hingedly connected to the rear wall, a major portion at a fixed relationship relative to the minor portion, said cover moveable between a first position closing the pouch, and a plurality of open positions; the plurality of open positions comprising a first position wherein the cover supports the body in a first orientation, and a second position wherein the cover supports the body in a second orientation.

23. A pouch as claimed in claim 22, wherein the fixed relationship comprises perpendicularity between the major portion and the minor portion.

* * * * *